US005239945A

United States Patent [19]

McCoy

[11] Patent Number: 5,239,945

[45] Date of Patent: Aug. 31, 1993

[54] APPARATUS TO REDUCE OR ELIMINATE COMBUSTOR PERIMETER WALL EROSION IN FLUIDIZED BED BOILERS OR REACTORS

[75] Inventor: Daniel E. McCoy, Williamsport, Pa.

[73] Assignee: Tampella Power Corporation, Williamsport, Pa.

[21] Appl. No.: 792,017

[22] Filed: Nov. 13, 1991

[51] Int. Cl.[5] ..... F23D 1/00

[52] U.S. Cl. ..... 122/4 D; 110/245

[58] Field of Search ..... 110/245; 122/4 D

[56] References Cited

U.S. PATENT DOCUMENTS

| | | | |
|---|---|---|---|
| 559,151 | 4/1896 | Thompson | 110/336 |
| 628,790 | 7/1899 | Gaines et al. | 110/336 |
| 868,485 | 10/1907 | Roberts | 110/122 |
| 3,565,408 | 2/1971 | Reh | 263/52 |
| 3,579,616 | 5/1971 | Reh et al. | 262/52 |
| 3,625,164 | 12/1971 | Spector | 110/1 J |
| 3,907,674 | 9/1975 | Roberts et al. | 210/20 |
| 4,084,545 | 4/1978 | Nack et al. | 122/4 D |
| 4,111,158 | 9/1978 | Reh et al. | 122/4 D |
| 4,165,717 | 8/1979 | Reh et al. | 122/4 D |
| 4,301,771 | 11/1981 | Jukkola et al. | 122/4 D |
| 4,449,482 | 5/1984 | Leon et al. | 122/4 D |
| 4,522,154 | 6/1985 | Taylor et al. | 122/4 D |
| 4,565,139 | 1/1986 | Sage et al. | 122/4 D |
| 4,714,049 | 12/1987 | McCoy et al. | 122/4 D |
| 4,947,804 | 8/1990 | Abdulally | 122/4 D |
| 4,955,323 | 9/1990 | Ziemianek | 122/4 D |
| 5,005,528 | 4/1991 | Virr | 122/4 D |

FOREIGN PATENT DOCUMENTS

| | | |
|---|---|---|
| 164429 | 8/1955 | Australia . |
| 8600510 | 11/1987 | Sweden . |

OTHER PUBLICATIONS

John Stringer and Jeff Stallings, "Materials Issues in Circulating Fluidized-Bed Combustors", *Fluidized Bed Combustion*, ASME 1991, pp. 589-608.

Jason, Makansi, Special Report: Fluidized-Bed Boilers, *Power*, Mar. 1991.

Prabir Basu, Circulating Fluidized Bed Technology, Proceedings of the First Int'l Conference on CFB, Halifax Canada, Nov. 18-20, 1985.

Lother Reh, "Highly Expanded Fluidbeds and Melting Cyclones for High-Temp. Reactions Between Gases and Fine Particles".

*Primary Examiner*—Henry C. Yuen

*Attorney, Agent, or Firm*—Ailes, Ohlandt & Greeley

[57] ABSTRACT

A fluidized bed boiler or reactor comprising a housing, a reaction (furnace) chamber within the housing, air distribution means within the reaction chamber, a plurality of perimeter walls approximately vertically disposed and arranged about the interior walls of the housing so as to define the reaction chamber, wherein the improvement comprises: providing at least a portion of the vertically disposed perimeter walls with an outward slope sufficient to reduce or eliminate erosion of the perimeter walls caused by impact from entrained solid particles contained within the reaction chamber.

18 Claims, 9 Drawing Sheets

APPARATUS TO REDUCE OR ELIMINATE COMBUSTOR PERIMETER WALL EROSION IN FLUIDIZED BED BOILERS OR REACTORS

The present invention relates generally to the burning of carbonaceous material, such as coal, wood, petroleum coke and other combustibles, in a fluidized bed boiler or reactor. It is primarily directed to a circulating fluidized bed boiler or reactor configured to reduce or eliminate reaction (furnace) chamber perimeter wall (i.e., side wall, front wall, and rear wall) erosion which is caused by the downward velocities of entrained solid particles which strike protrusions, projections, non-uniform perimeter wall geometry or refractory interfaces on the walls.

BACKGROUND OF THE INVENTION

Fluidized bed reactors are effective means for generating heat and, in various forms, can carry out the processes of drying, roasting, calcining, heat treatment of solids with gases in the chemical, metallurgical, and other material processing fields, and the generation of hot gases, including steam, for use in driving electric power generation equipment, for process heat, for space heating or for other purposes. In a reactor generating hot gases, air is passed through a bed of particulate material which includes a mixture of inert material and a fuel material such as coal, wood waste or other combustible materials. Where the combustion of bituminous or anthracite coal or other fuels containing a high sulfur component is undertaken, a material such as lime or limestone which will react with the sulfur released by combustion may be provided in the bed.

Fluidized bed technology has been widely applied to accomplish a variety of chemical reactions, heating, cooling and other processes for the past few decades. In the United States fluidized beds were first used as a combustion technique starting in the late 1960's and early 1970's. Initially, bubbling fluidized beds were the preferred technology; however, gradually the emphasis was shifted to circulating fluidized beds. Bubbling fluidized beds operate at lower superficial velocities than circulating fluidized beds, usually 3-6 feet per second verses 18-22 feet per second, respectively. Superficial velocities refer to the velocity of the products of combustion in the reaction chamber just above the dense bed area.

The use of fluidization as a combustion technique is accomplished by having the chemical reactions of combustion take place in a bed of granular material which has been suspended, or lifted, or fluidized by all, or part of the combustion air. If the mean particle size of the granular material is sufficiently small and/or if the velocity of the combustion air is high enough, very high quantities of the bed material are entrained, or elutriated by the products of combustion and there is virtually no discernable level of top-of-bed.

A typical bubbling fluidized bed boiler system is described in U.S. Pat. No. 4,301,771 (Jukkola et al.), which issued on Nov. 24, 1981. The reaction chamber consists of a bubbling bed in the lower section and a freeboard in the upper section, all encased in a watercooled membrane wall. The membrane wall may provide a part or all of the required heat transfer surface area for heat recovery. Additional heat transfer surface area, if necessary, can be provided by in-bed tubes.

Circulating fluidized bed boiler or reactor systems involve a two phase gas-solids process which promotes solids entrainment within the upflowing gas stream in the reaction chamber and then recycles the solids back into the reaction chamber with a high rate of solids circulation. The rate of solids circulation in the circulating fluidized bed process is about fifty times that of a bubbling bed process. Moreover, circulating fluidized bed systems typically use elongated reaction chambers which increase solids residence time, thus increasing carbon combustion efficiency, increasing heat transfer, and decreasing carbon monoxide emission levels.

Circulating fluidized bed boilers produce both a dense bed or "bubbling" bed and a dilute phase or "fast" bed. The bubbling bed is at the bottom of the reaction chamber with the dilute phase above. The dilute phase will typically have solid loadings of 3 to 9 pounds per pound of gas. Operation with both a dense and dilute phase is achieved by permitting some of the combustion air to bypass the dense bed and enter at the bottom of the dilute phase. The dilute phase gives very good turbulence and mixing with no streamline or laminar flow. The "slip" between velocities of the entrained solids and the flue gas is quite large and this gives good solids "fallback" or "back-mixing".

Various examples of known circulating fluid bed systems are described in U.S. Pat. Nos. 4,1656,717 (Reh et al.), which issued on Aug. 28, 1979, and 3,625,164 (Spector), which issued on Dec. 7, 1971, and an article by A. M. Leon and D. E. McCoy, "Archer Daniels Midland (ADM) Conversion to Coal," *Circulating Fluidized Bed Technology*, Proceedings of the First International Conference on Circulating Fluidized Beds, Pergamon Press, Nov. 18-20, 1985, pp. 341-348.

FIG. 1, attached hereto, demonstrates one conventional circulating fluidized bed boiler system contemplated herein. FIG. 1 is a schematic representation of a circulating fluidized bed steam generator system comprising a reaction chamber 1 formed by a disc-type seal-welded membrane waterwall 2, all of which is encased in a metal frame or housing 3. A distribution plate 4 is disposed at the bottom of reaction chamber 1 wherein primary air 5 is introduced to the lower portion of reaction chamber 1 via a windbox 6 and distributed via constriction plate or distributor 4 together with tuyeres 8.

Windbox 6 is an air chamber encased by seal-welded waterwalls 2 which are extensions from the waterwall forming reaction chamber 1. Disposed at the lower portion of reactor 1 is a refractory material 7 used to protect the membrane waterwall from erosion due to the high turbulence in the dense bed. Air from windbox 6 is introduced to the lower portion of reaction chamber 1 via tuyere 8. Secondary air is introduced via secondary air inlets 9 which are located above the recycle port 10. Optionally, secondary air may also be introduced through lower secondary air inlets 11 which may be located on or near the same plane as recycle port 10.

Water is introduced to membrane waterwalls 2 and heat exchange tubes 12 via water drum 13. Carbonaceous materials, such as coal, wood, petroleum coke or the like, and a desulfurizing agent, such as limestone, are introduced into reaction chamber 1 via feed conduit 14. Carbonaceous material and desulfurizing agent are usually introduced to the lower portion or dense bed of reaction chamber 1. Prior to the introduction of the carbonaceous material start-up burner 25 is ignited to bring the temperature within reaction chamber 1 up to operating conditions.

Thereafter, primary air 5 is introduced via windbox 6 and tuyeres 8 for fluidizing the carbonaceous material. Simultaneously, burners 25 are used to ignite the carbonaceous material as it moves through reaction chamber 1 in contact with oxygen-containing fluidizing gas. The primary air is usually insufficient to burn all of the incoming fuel completely and creates a substoichiometric condition, which deliberately induces an incomplete combustion process under a reducing atmosphere. This is deliberately done in an attempt to limit oxidation of devolatized fuel nitrogen. Devolatized fuel nitrogen may be partially oxidized upon coming into contact with oxygen. However, under a reducing atmosphere which is rich in carbon and carbon monoxide, substantial quantities of the oxidized nitrogen oxide would be reduced to elemental nitrogen. The result is low nitrogen oxide emissions, which is often necessary under air pollution regulations.

As the gas stream leaves the dense bed it carries incomplete combustion product with it. At this junction secondary air is introduced via inlets 9, and optionally through inlets 11, in sufficient quantity to complete combustion of the carbonaceous material. Moreover, unburned carbon or carbon monoxide is subjected to an ample supply of oxygen via the secondary air, and further oxidized to carbon dioxide throughout the remainder of reaction chamber 1. This avoids emission problems which occur when carbon monoxide is exhausted from the system.

Flue gas is discharged from reaction chamber 1 via discharge conduit 15 into particle separator 16. The particle separator 16 is typically a cyclone design which separates solids entrained in the flue gas discharged from reaction chamber 1, and recycles the separated solids via pressure seal 17 and recycle port 10 back to the lower portion of reaction chamber 1. It is important that the separated solids from particle separator 16 be recycled at a point below secondary air inlets 9. This assists in maintaining the low density of the dilute phase above the dense bed, i.e., a solids density approximately in the range between about 0.2 to 1.25 $lb/ft^3$. It also increases the solids residence time which enhances the combustion efficiency of the system.

Optionally, at least one bed drain port 18 is disposed at the lower end of reaction chamber 1 to permit the removal of bed material, such as rocks, stones, used limestone, etc. Bed drain port 18 is connected to ash classifier 2 via bed drain conduit 19. Bed drain conduit 19 includes a control valve 20 which regulates the quantity of bed material removed at any given time. The bed material is then transferred to ash classifier 21 which separates fine particles from coarser fractions of the bed material, disposing of the coarser fraction via conduit 22 and returning the fine particles to reaction chamber 1 via conduit 23. Recycling of fines assists in maintaining the low solids density in the dilute phase and also increases the combustion efficiency of the system.

There are two regimes of fluidization in reaction chamber 1: (1) the lower dense bed where the coal, sorbent and recycled solids are mixed, and (2) an upper dilute phase where combustion is completed, sulphur products are absorbed, and heat is transferred to the water-cooled walls. The depth of the dense bed is usually 3 to 4 feet while the height of the dilute phase is usually 60 to 80 feet.

The two regimes are accomplished by bypassing some of the combustion air around the dense bed. The bypassed or secondary air enters above the dense bed at one or more levels. All levels of secondary air are usually introduced to the reaction chamber by ports arranged around the entire perimeter.

Despite the rapid development of fluid bed combustion technology, the problem of erosion of waterwall tubes and in-bed heat exchange tubes, as well as refractory-lined, tangent tube or metal plate walls, remains. The problem of erosion of in-bed heat exchange tubes was addressed in U.S. Pat. No. 4,714,049 (McCoy et al.), which issued on Dec. 22, 1987. This patent reduced or eliminated fluid bed in-bed tube erosion by increasing the fireside tube temperature by adding appropriately dimensioned longitudinal or circumferential fins to the in-bed heat exchange tubes in the reaction chamber.

Although U.S. Pat. No. 4,714,049 addressed erosion of in-bed heat exchange tubes, it did not contemplate the erosion problems associated with waterwall tubes, refractory bricks, tangent tubes or metal plates disposed about the perimeter of the reaction chamber. The problem of erosion of reaction chamber perimeter walls is documented in U.S. Pat. No. 5,005,528 (Virr), which issued on Apr. 9, 1991, and an article by Jason Makansi, "Special Report: Fluidized-Bed Boilers," *Power*, March 1991.

U.S. Pat. No. 5,005,528 suggests that one major disadvantage with conventional circulating fluidized bed boilers is severe erosion of the boiler's heat exchange tubes, especially those tubes which line the perimeter walls and roof of the combustor. The inventor thereof suggested that the erosion is caused by the high velocities necessary to achieve satisfactory heat transfer. It was observed that some tubes were away and fail after only 1,000 hours of operation, particularly those tubes located in the roof and corners of the reaction chamber. Various palatable methods have been proposed to combat erosion, such as, fins, metal spray, studs and refractory-linings. However, each of the aforementioned methods is extremely expensive and thus commercially undesirable. U.S. Pat. No. 5,005,528 overcame the waterwall tube erosion problem by means of a unique bubbling fluid bed boiler with recycle which incorporated the advantages of both the circulating fluid bed and bubbling fluid bed systems. This design, however, does not overcome the waterwall tube or other perimeter wall erosion prevalent in conventional circulating fluidized bed boilers designs.

The Makansi article suggests that increases in solids velocity to augment heat transfer and attain rated steam load caused erosion to become worse. Designs with lower velocities and/or low solids density experience generally less erosion. Makansi also pointed out that one type of erosion has been identified and classified as "sliding-ash" erosion. That is, particles flowing downward between water-cooled membrane tube walls of the combustor hit projections, such as, weld beads, and are deflected into the tubes. This results is an eventual failure of the waterwall tube. The current means for preventing sliding ash erosion is the removal of irregularities or abrupt changes in geometry by grinding, filling, or weld overlay.

Makansi identifies another area where erosion persists at the interface between the lower refractory-lined combustor bed area and the waterwall tubes. Several plants have installed small shelves to break up solids refluxing patterns. Another approach involved raising the height of the refractory level and applying a plasma spray coating to waterwalls on a three foot zone above the interface. However, some heat transfer capacity was lost. Still others have suggested that the basic interface design be modified by angling the waterwall tubes away from the furnace by bending the tubes in a serpentine manner directly above the interface to shield the interface from the solid particles.

This persistent problem of combustor or reaction chamber perimeter wall erosion is one of the largest deterrents associated with marketing and commercializing circulating fluidized bed boilers and reactors. A typical combustor perimeter wall construction for a circulating fluid bed boiler or reactor is shown in FIG. 2, attached hereto. The construction is commonly called "membrane" or "welded" wall where tubes 30 are welded together with longitudinal bars 32 between them. Between housing 34 is disposed insulation 36.

FIGS. *3a–3c* clearly demonstrate known erosion points caused by downflowing solid particles impacting a vertically disposed waterwall tube. These erosion points require periodic repair and replacement which is not only costly in terms of maintenance, but also requires the shutting down of the boiler or reactor itself in order to perform such maintenance. Maintenance cost and service interruption are of great concern and constant investigation by boiler and reactor fabricators.

The present inventor has developed various unique reaction chamber or combustor configurations which substantially reduce or eliminate erosion of waterwall tubes or other types of perimeter walls used in fluidized bed boilers or reactor. The present invention to reduce or eliminate reaction chamber perimeter wall erosion applies equally to all perimeter wall construction, e.g., waterwall tube, metal plate, tangent tube, and refractory brick construction. It is particularly suited for reducing or eliminating erosion about reaction chamber perimeter walls having non-uniform geometry, protrusions, projections, etc. Some examples of which are: (1) tubes bent for openings such as the coal feed pipes or observation ports, (2) weld projections where tubes are welded together, and (3) the interface between refractory bricks and the perimeter wall.

The present invention also provides many additional advantages which shall become apparent as described below.

SUMMARY OF THE INVENTION

A fluidized bed boiler or reactor comprising a housing, a reaction chamber within the housing, air distribution means within the reaction chamber, a plurality of membrane waterwall tubes approximately vertically disposed and arranged about the interior walls of the housing so as to define the reaction chamber, wherein the improvement comprises: providing at least a portion of the vertically disposed waterwall tubes with an outward slope sufficient to reduce or eliminate erosion of the waterwall tubes caused by impact from entrained solid particles. Typically, the outward slope of the waterwall tubes occurs throughout the entire reaction chamber such that the upper diameter of the reaction chamber is less than the lower diameter, i.e., a conical configuration.

Optionally, the waterwall tubes are provided with an outward slope at or near the interface of the waterwall tubes and areas of non-uniform geometry, protrusions, or projections, such as, refractory bricks, external feed pipes, observation ports, weld projections, or lugs.

The outward slope of the waterwall tubes is in the range from between about 0.05° to about 10°.

According to another embodiment of the present invention a circulating fluid bed steam generator is provided with a reaction chamber comprising a plurality of vertically disposed waterwall tubes; a discharge conduit disposed at the top of the reaction chamber for the discharge of flue gas containing entrained solid particles therein; a particle separator connected to the discharge conduit for separating the entrained solid particles from the discharged flue gas, the entrained solid particles being returned to the reaction chamber at a lower portion thereof via a recycle port; means for introducing a carbonaceous material to a lower portion of the reaction chamber; primary inlet means for introducing a fluidizing gas disposed at the bottom of the reaction chamber; and secondary inlet means for introducing a fluidizing gas disposed above the recycle port wherein a dense bed of the carbonaceous material is formed below the secondary inlet means and a dilute phase is formed above the dense bed, the dilute phase having a density in the range between about 0.2 to about 1.25 $lb/ft^3$, wherein the improvement comprises: providing at least a portion of the vertically disposed waterwall tubes with an outward slope sufficient to reduce or eliminate erosion of the waterwall tubes caused by impact from entrained solid particles.

It is also an object of the present invention to provide a fluidized bed boiler or reactor comprising a housing, a reaction chamber within the housing, air distribution means within the reaction chamber, a plurality of perimeter walls approximately vertically disposed and arranged about the interior walls of the housing so as to define the reaction chamber, wherein the improvement comprises: providing at least a portion of the vertically disposed perimeter walls with an outward slope sufficient to reduce or eliminate erosion of the perimeter walls caused by impact from entrained solid particles. The perimeter walls are formed from either metal plates, refractory bricks or tangent tubes.

Other and further objects, advantages and features of the present invention will be understood by reference to the following specification in conjunction with the annexed drawings, wherein like parts have been given like numbers.

Figure 4:
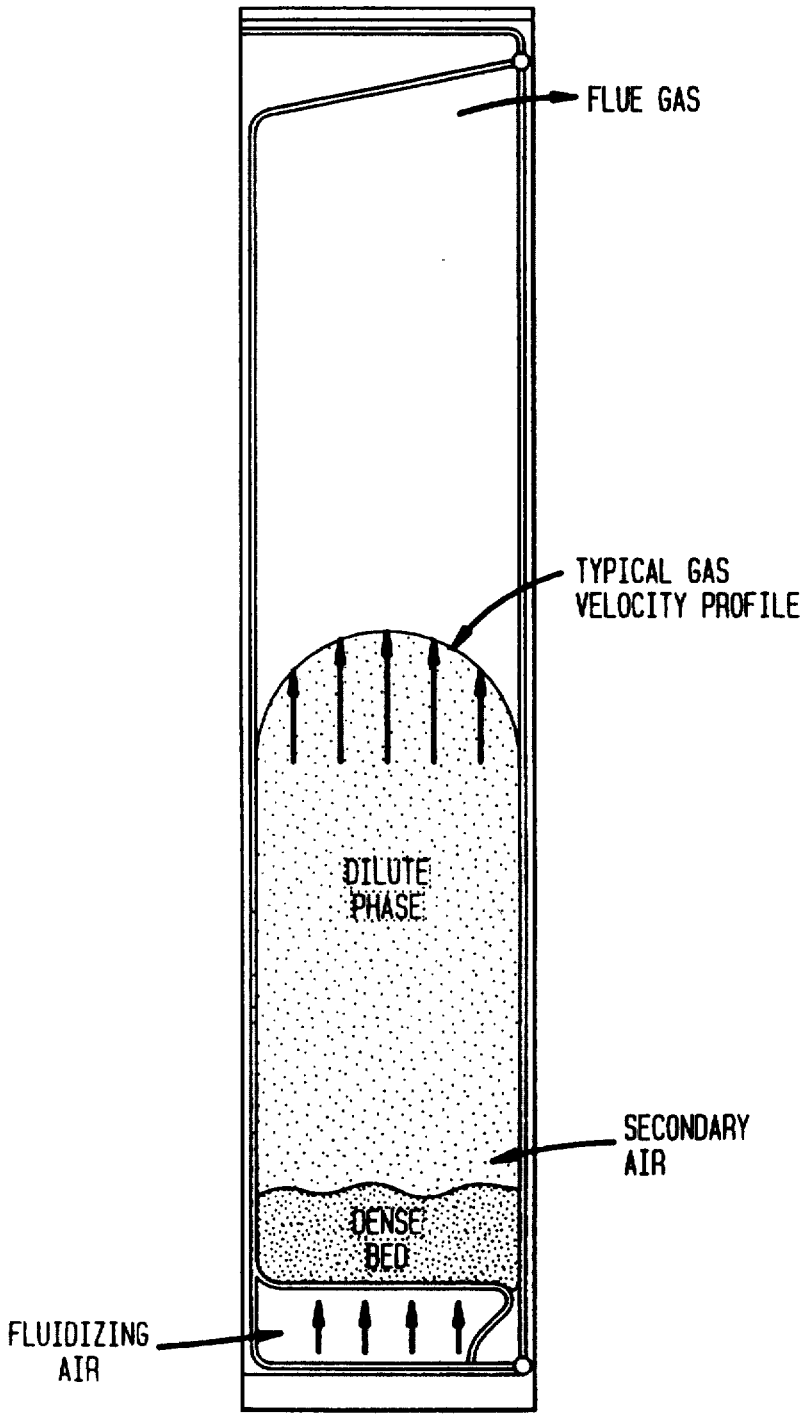
Figure 5:
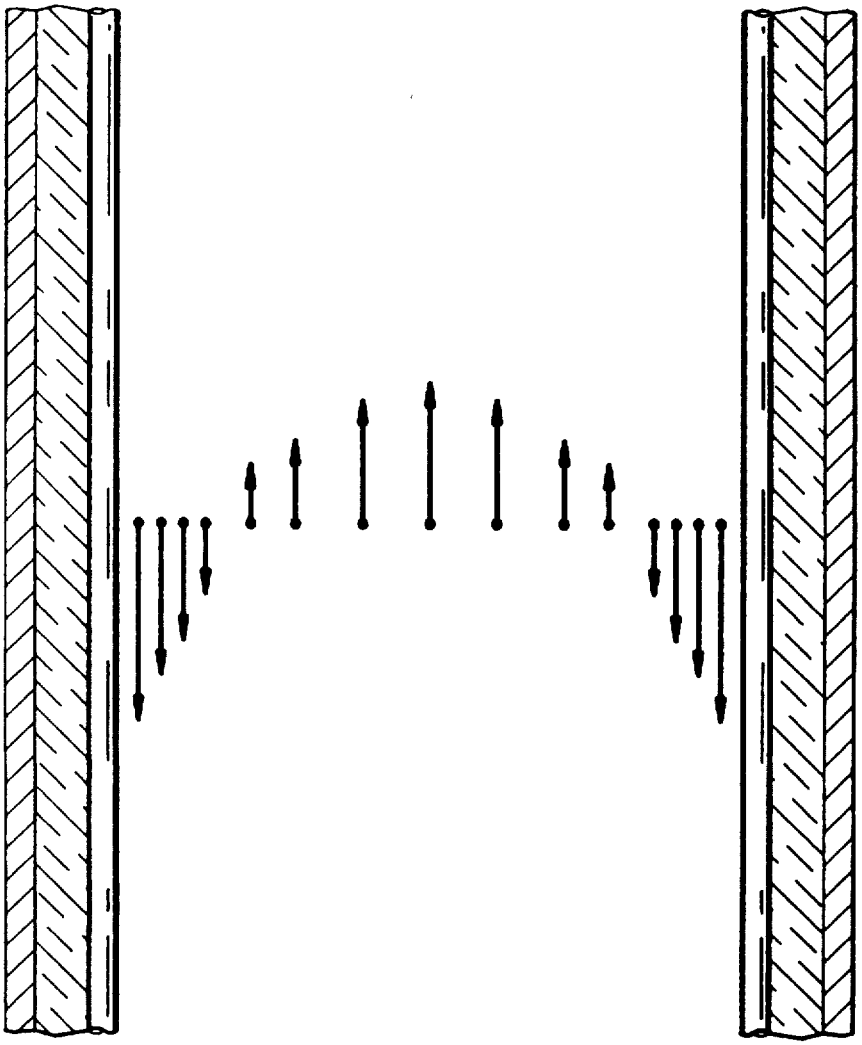
Figure 6:
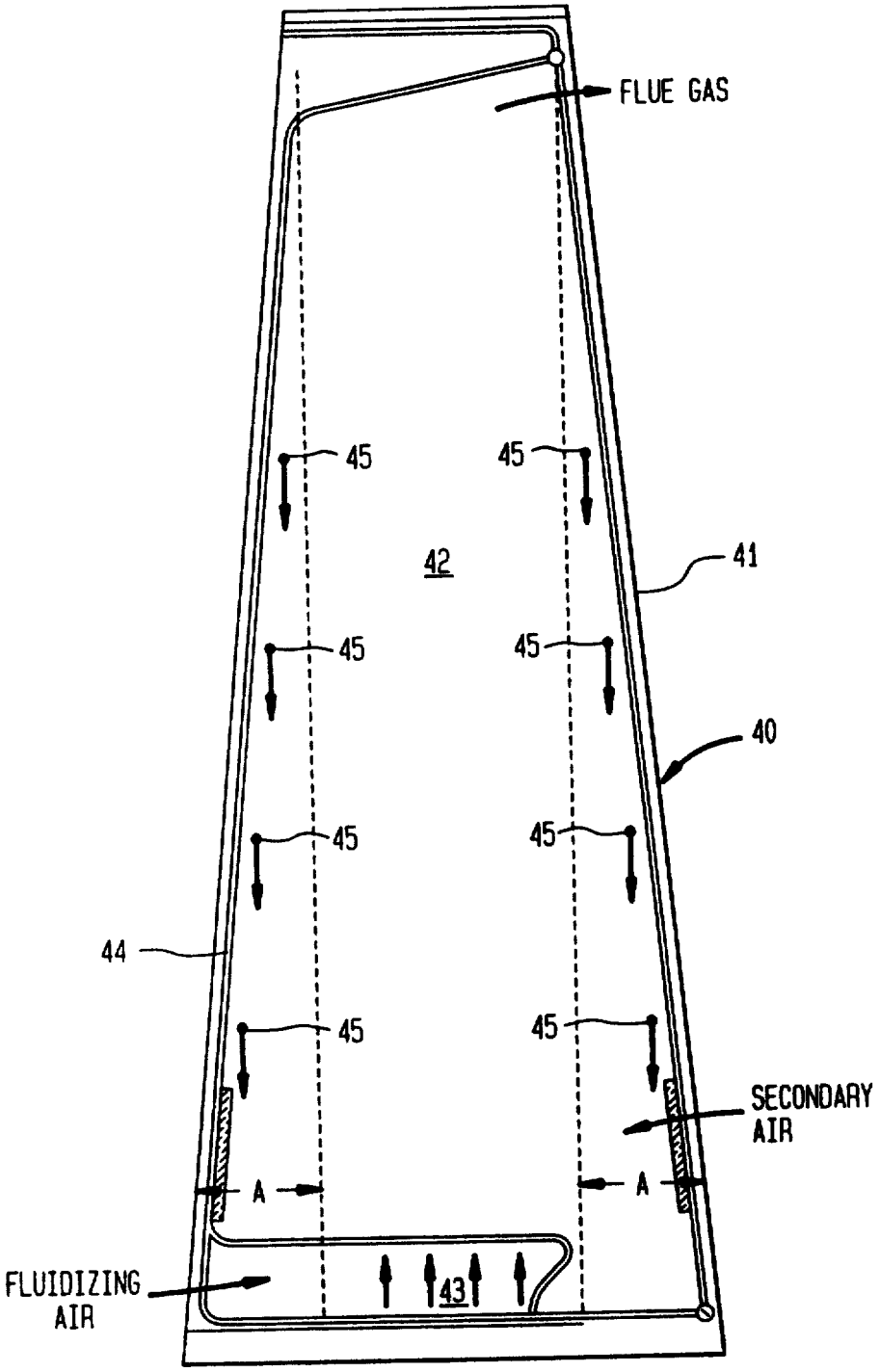
Figure 7A:
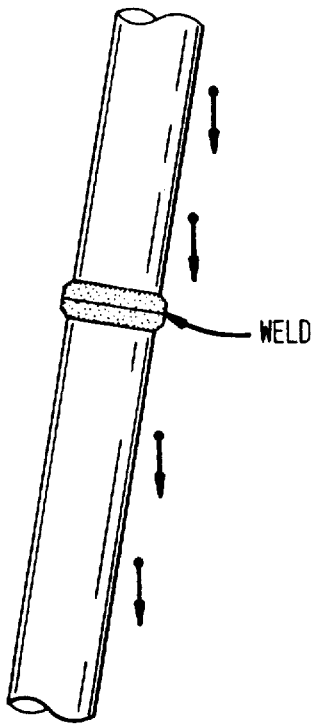
Figure 7B:
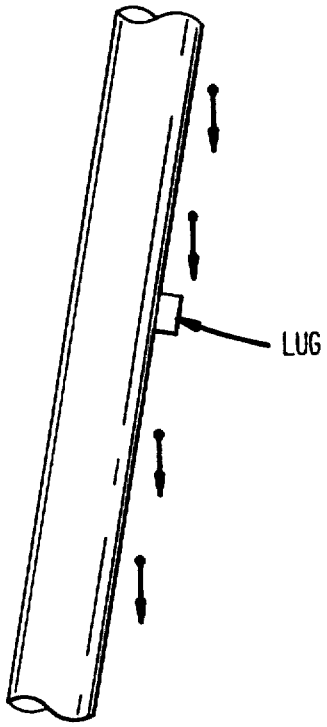
Figure 7C:
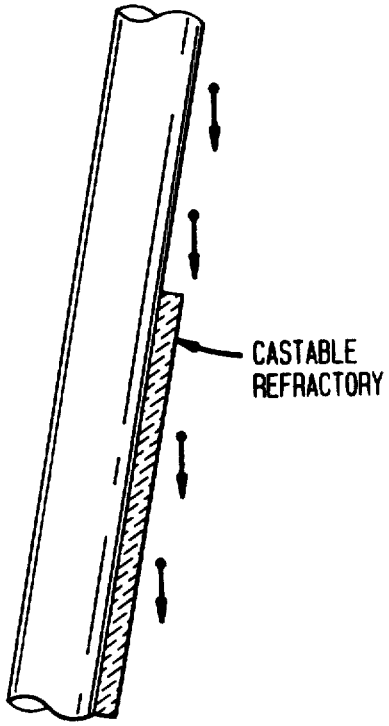
Figure 8A:
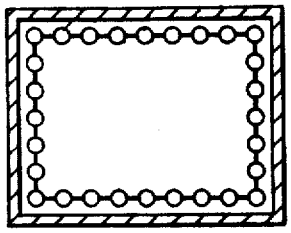
Figure 8B:
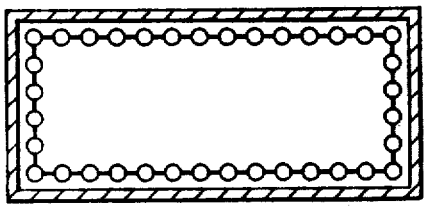
Figure 8C:
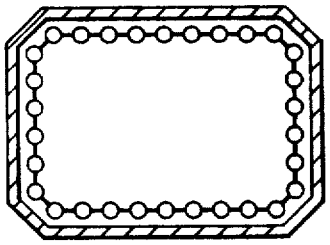
Figure 8D:
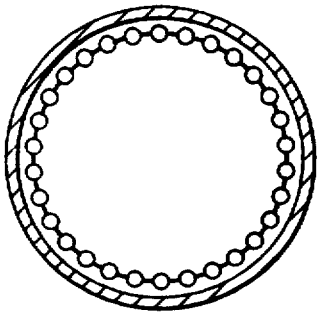
Figure 8E:
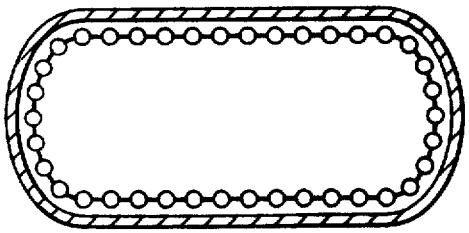
Figure 9:
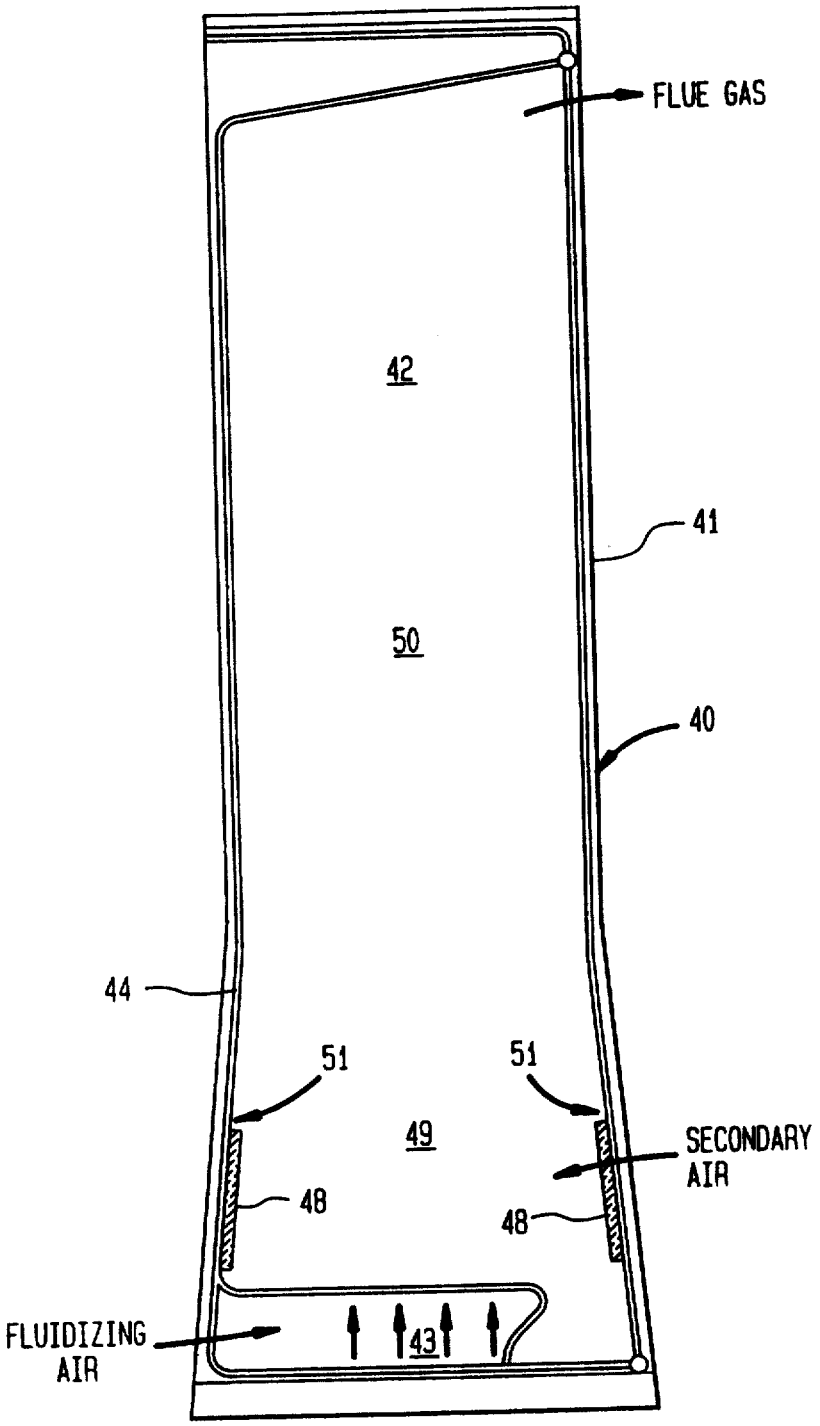
Figure 10:
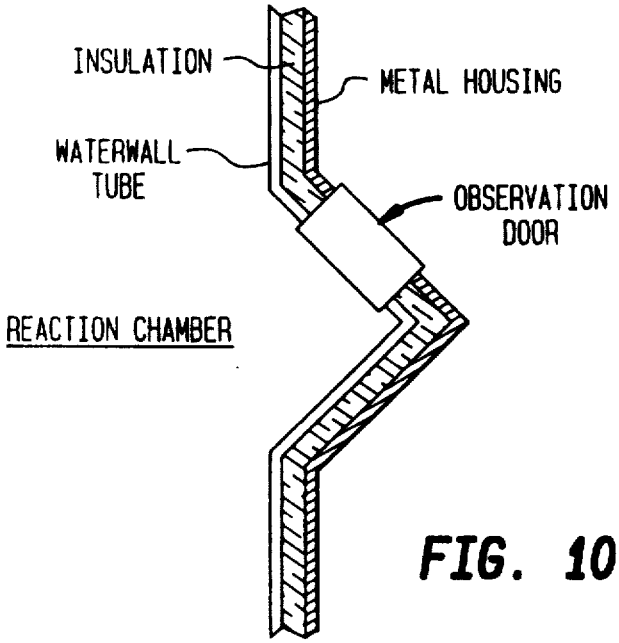
Figure 11:
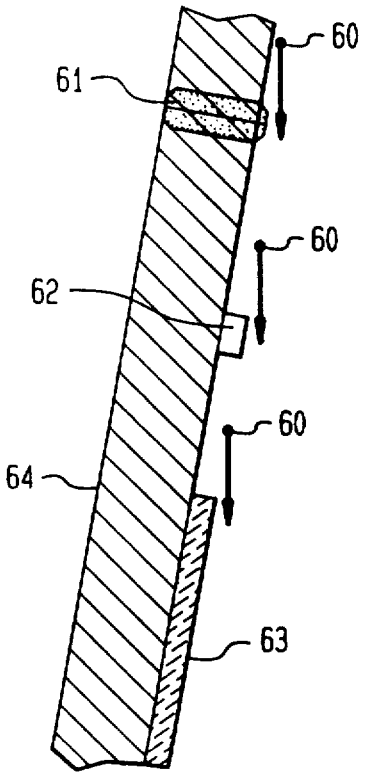
Figure 12:
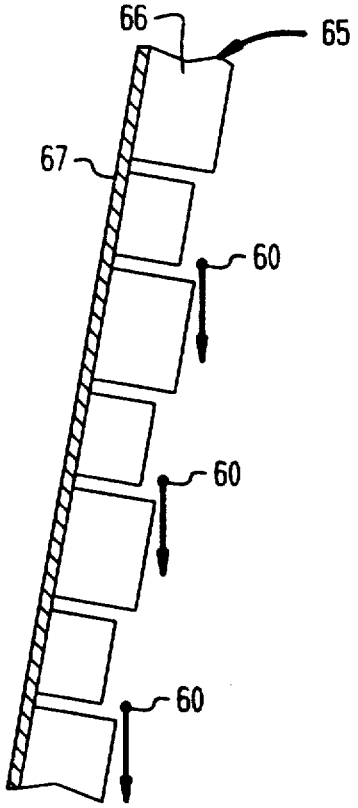

FIG. *3a* is a schematic representation of the erosion point formed by the impact of entrained solid particles at a weld on a vertically disposed waterwall tube;

FIG. *3b* is a schematic representation of the erosion point formed by the impact of entrained solid particles at a lug on a vertically disposed waterwall tube;

FIG. *3c* is a schematic representation of the erosion point formed by the impact of entrained solid particles at an interface between a refractory-lining and a waterwall tube;

FIG. 4 demonstrates the typical flue gas velocity profile in a circulating fluidized bed boiler;

FIG. 5 demonstrates density profiles and relative vertical velocities, as depicted by the vectors, of entrained solid particles in a typical circulating fluidized bed boiler;

FIG. 6 is a schematic representation of a circulating fluidized bed boiler with outward sloping waterwall tubes in accordance with one embodiment of the present invention;

FIG. 7a is a schematic representation of impact and directional orientation of entrained solid particles at a waterwall tube having a weld wherein the waterwall tubes have an outward slope according to the present invention;

FIG. 7b is a schematic representation of impact and directional orientation of entrained solid particles at a waterwall tube having a lug wherein the waterwall tubes have an outward slope according to the present invention;

FIG. 7c is a schematic representation of impact directional orientation of entrained solid particles at a waterwall tube having an interface between a refractory-lining and a waterwall tube wherein the waterwall tubes have an outward slope according to the present invention;

FIGS. 8a–8e depict various reaction chamber planar cross-sections which may be used in accordance with the present invention;

FIG. 9 is a schematic representation of a circulating fluidized bed boiler according to another embodiment of the present invention wherein only that portion of the waterwall tubes disposed at or near the interface between a refractory-lining and the waterwall tubes is provided with an outward slope;

FIG. 10 is a schematic representation of outward sloping waterwall tubes disposed at or near an observation door of a boiler or reactor in accordance with another embodiment according to the present invention;

FIG. 11 is a schematic representation of impact and directional orientation of entrained solid particles at a metal plate perimeter wall in accordance with another embodiment of the present invention; and FIG. 12 is a schematic representation of impact and directional orientation of entrained solid particles at a refractory brick perimeter wall in accordance with another embodiment of the present invention.

DESCRIPTION OF THE PREFERRED EMBODIMENTS

The present invention provides various unique waterwall tube and other type of perimeter wall configurations for use in fluidized bed boilers and reactors in order to reduce or eliminate perimeter wall erosion. This invention applies equally to all types of perimeter wall construction, i.e., waterwall tube, tangent tube, metal plate or refractory brick construction. It is particularly effective in reducing or eliminating perimeter wall erosion at points of non-uniform geometry, protrusions or projections disposed along the waterwall tube or other perimeter wall.

To comprehend the damaging erosive effect which entrained solid particles have on waterwall tubes and other types of perimeter walls used in circulating fluidized bed boilers or reactors, the present inventor first had to completely develop an understanding of the unique fluid dynamics occurring within the reaction chamber itself. As shown in FIG. 4, the velocity profile of the flue gas (i.e., products of combustion) up through the reaction chamber is typical of gas flow in any sort of duct. Generally, the profile is parabolic in shape wherein the flue gas closest to the perimeter wall has a lower velocity than that in the center of the reaction chamber. The velocity profile directly above the dense bed is more uniform and the typical parabolic profile is observed at higher levels within the reaction chamber. As previously mentioned, the flue gas carries a large amount of entrained solid particles. As the solids laden flue gas makes its way up the reaction chamber, the flue gas velocity at the perimeter walls becomes less and some of the solids in those areas are no longer entrained by the flue gas (i.e., Stokes Law) and fall downward. In addition, all of the entrained solids are not flowing in a streamline fashion but are "gurgling" or in a partial "plug" flow type regime where each solid particle has a more or less random velocity with a horizontal component. This results in solids leaving the higher velocity areas and actually striking the perimeter walls. This phenomenon provides for additional falling or downflow of solid particles at the perimeter walls. The "raining" or downflow of solids at the perimeter walls is very heavy (see FIG. 5) and solids may have downward velocities several times greater than the maximum upflow velocity (i.e., flue gas velocity) due to the acceleration caused by the force of gravity.

The present inventor has observed that the rate of erosion depends on a number of variables, such as, particle hardness, particle size, etc., but the primary consideration is that of the velocity of the solid particle when it strikes the surface at which erosion is taking place. The "raining" or "curtain" of falling solid particles at the perimeter walls cause serious erosion on the top of any protrusions, such as, weld beads, top of bent tubes or the interface where refractory brick is applied to the perimeter walls. The erosion caused by the raining effect has been observed by the present inventor on most operating circulating fluidized bed systems known to him and has been reported on by others.

The present invention involves the outward sloping of the vertical waterwall tubes or other types of perimeter walls disposed about the reaction chamber such that once a solid particle strikes the perimeter wall it falls away therefrom as illustrated in FIGS. 6 and 7a–7c.

FIG. 6 depicts one preferred embodiment according to the present invention wherein a fluidized bed boiler or reactor 40 comprising a housing 41, a reaction chamber 42 within housing 41, air distribution means 43 within reaction chamber 42, a plurality of waterwall tubes 44 approximately vertically disposed and arranged about the interior walls of housing 41 so as to define reaction chamber 42. According to the present invention fluidized bed boiler or reactor 40 is provided with at least a portion of the vertically disposed waterwall tubes 44 with an outward slope sufficient to reduce or eliminate erosion of waterwall tubes 44 normally caused by impact from entrained solid particles 45.

The outward slope of waterwall tubes 44 occurs throughout the entire reaction chamber 42 such that the upper diameter of reaction chamber 42 is less than the lower diameter.

Figure 1:
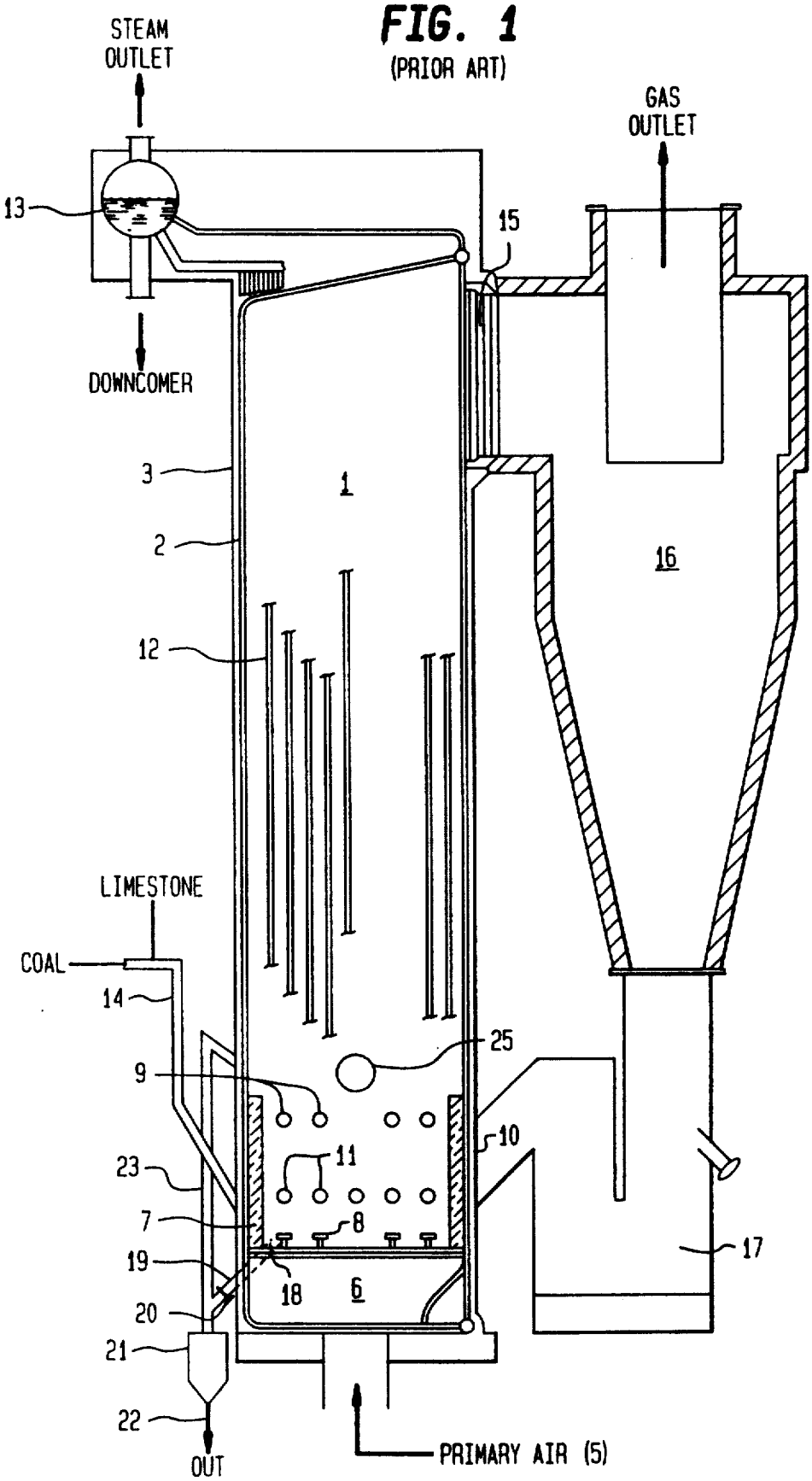
FIG. 1 (PRIOR ART)
FIG. 1 is a schematic representation of a conventional circulating fluidized bed boiler having vertically disposed membrane waterwalls.
Figure 2:
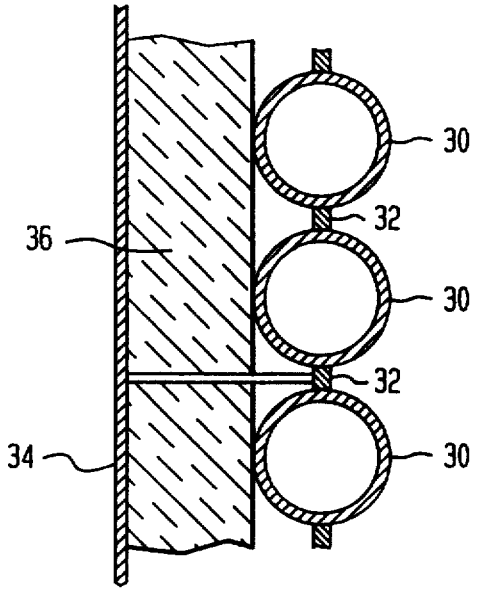
FIG. 2 is a schematic representation of a conventional membrane waterwall construction.
Figure 3A:
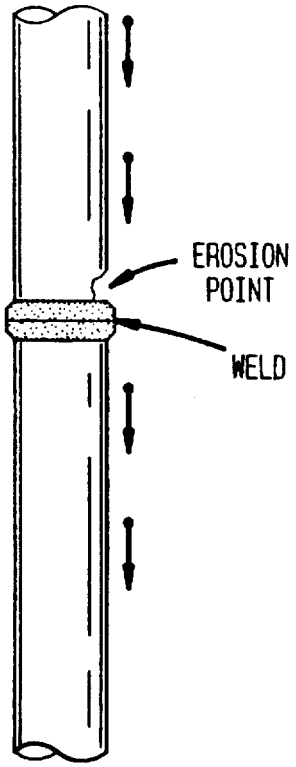
Figure 3B:
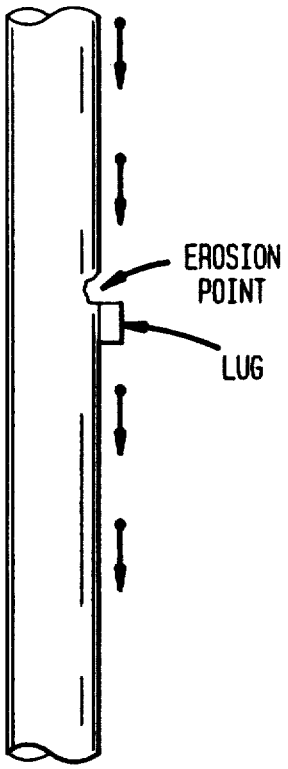
Figure 3C:
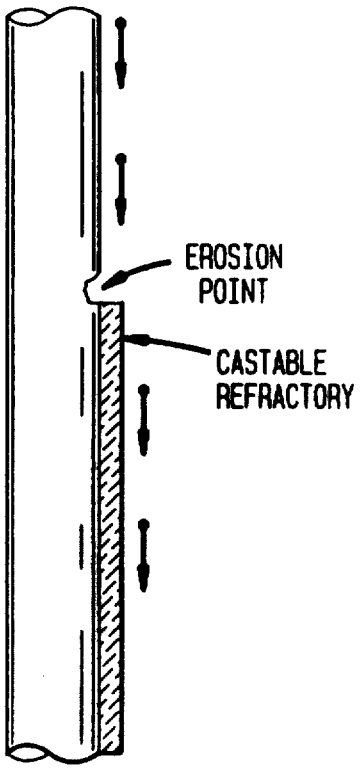

FIGS. 7a–7c demonstrate the effect that downflowing entrained solid particles have on outward sloping waterwall tubes containing protrusions, such as, welds or lugs, and refractory brick interfaces, respectively. Even if a solid particle does impact a weld, lug, or refractory interface disposed on an outward sloping waterwall tube or other type of perimeter wall, it would have a much lower velocity since by the time the solid particle has accelerated to a highly erosive velocity it would have fallen to a point that was out beyond the waterwall tube or projection or protrusion. To the contrary, vertically disposed waterwall tubes as shown in FIGS. 3a–3c experience substantial erosion at the various erosion points. The present invention would also prevent the erosion shown in FIGS. 3a–3c since the solid particle would not be striking the protrusion, projection or interface at the exact intersection point of it and the waterwall tube. Any contact between the falling solid particle and the protrusion, projection or interface would simply just tend to wear the protrusion, projection or refractory brick away within gouging or damaging the waterwall tube.

The present invention would reduce erosion regardless of the cross-sectional configuration of the reaction chamber. FIGS. 8a–8e depict various reaction chamber planar cross-sections which are particularly of use. However, the square and rectangular cross-sections provide corners which further depress upward velocities increasing the "raining" or "curtain" of falling solid particles in those areas. The preferred reaction chamber planar cross-sections are those set forth in FIGS. 8c–8e.

FIG. 9 depicts another embodiment in accordance with the present invention wherein a fluidized bed boiler or reactor 40 comprising a housing 41, a reaction chamber 42 within housing 41, air distribution means 43 within reaction chamber 42, a plurality of waterwall tubes 44 approximately vertically disposed and arranged about the interior walls of housing 41 so as to define reaction chamber 42.

According to a preferred embodiment of the present invention the fluidized bed boiler or reactor 40 is a circulating fluidized bed boiler or reactor having a dense bed 49 and a dilute phase 50. As shown in FIG. 9, refractory 48 is disposed about waterwall tubes 44 in dense bed 49 and wherein waterwall tubes 44 have an outward slope at or near the interface 51 of waterwall tubes 44 and refractory 48. In some applications it may be preferable that circulating fluidized bed boiler or reactor 40 only have a "fast" bed or dilute phase without any dense bed.

The outward slope of waterwall tubes or any perimeter wall is preferably in the range from between about 0.05° to about 10°.

Optionally, waterwall tubes or other types of perimeter walls can be provided with an outward slope at or near the interface of the perimeter walls and areas of non-uniform geometry, protrusions, or projections, such as, refractory bricks, external feed pipes, observation ports, weld projections, or lugs. FIG. 10 demonstrates one possible modification of the waterwall tubes near an observation door wherein only that portion of the waterwall tube near the observation door is provided with an outward slope to reduce or eliminate erosion at the interface of the waterwall tubes and observation door. Such modifications are also envisioned with regard to other such protrusion, projections, non-uniform perimeter wall geometry or refractory interfaces.

FIGS. 11 and 12 demonstrate that it is contemplated hereunder that this invention can be used with any other type of reaction chamber perimeter wall, such as, tangent tube, metal plate, and refractory brick constructions. FIG. 11 shows that solid particles 60 fall away from weld 61, lug 62 and refractory interface 63 disposed about metal plate 64. FIG. 12 shows that solid particles 60 fall away from a refractory-lined perimeter wall 65 comprising refractory brick 66 and metal housing 67.

While I have shown and described several embodiments in accordance with my invention, it is to be clearly understood that the same are susceptible to numerous changes apparent to one skilled in the art. Therefore, I do not wish to be limited to the details shown and described but intend to show all changes and modifications which come within the scope of the appended claims.

What is claimed is:

1. A fluidized bed boiler or reactor comprising a housing, a reaction chamber within said housing, air distribution means within said reaction chamber, a plurality of waterwall tubes approximately vertically disposed and arranged about the interior walls of said housing so as to define said reaction chamber, wherein the improvement comprises:

providing at least a portion of the vertically disposed waterwall tubes with an outward slope in the range between 2.5° to 10° such that the cross-section of the upper portion of said reaction chamber is smaller than the cross-section of the lower portion of said reaction chamber so as to reduce or eliminate erosion of said waterwall tubes caused by impact from downward flowing solid particles.

2. A fluidized bed boiler or reactor according to claim 1 wherein the outward slope of said waterwall tubes occurs throughout the entire length of said reaction chamber.

3. A fluidized bed boiler or reactor according to claim 1 wherein said waterwall tubes are provided with an outward slope at or near the interface of said waterwall tubes and areas of non-uniform geometry, protrusions, or projections, such as, refractory, external feed pipes, observation ports, weld projections, or lugs.

4. A fluidized bed boiler or reactor according to claim 1 wherein said fluidized bed boiler is a circulating fluidized bed boiler having a dense bed and a dilute phase.

5. A fluidized bed boiler or reactor according to claim 4 wherein refractory is disposed about said waterwall tubes in said dense bed and wherein said waterwall tubes have an outward slope at or near the interface of said waterwall tubes and said refractory.

6. A fluidized bed boiler or reactor according to claim 1 wherein said reaction chamber has either a square, rectangular, circular or oblong cross-section.

7. A circulating fluid bed steam generator comprising:

a reaction chamber comprising a plurality of vertically disposed waterwall tubes;

a discharge conduit disposed at the top of said reaction chamber for the discharge of flue gas containing entrained solid particles therein;

a particle separator connected to said discharge conduit for separating the entrained solid particles from the discharged flue gas, said entrained solid particles being returned to said reaction chamber at a lower portion thereof via a recycle port;

means for introducing a carbonaceous material to a lower portion of said reaction chamber;

primary inlet means for introducing a fluidizing gas disposed at the bottom of said reaction chamber; and secondary inlet means for introducing a fluidizing gas disposed above said recycle port wherein a dense bed of said carbonaceous material is formed below said secondary inlet means and a dilute phase is formed above said dense bed, said dilute phase having an approximate density in the range between about 0.2 to about 1.25 lb/ft$^3$, wherein the improvement comprises:

providing at least a portion of the vertically disposed waterwall tubes with an outward slope in the range between 2.5° to 10° such that the cross-section of the upper portion of said reaction chamber is smaller than the cross-section of the lower portion of said reaction chamber so as to reduce or eliminate erosion of said waterwall tubes caused by impact from downward flowing solid particles.

8. A circulating fluid bed steam generator according to claim 7 wherein the outward slope of said waterwall tubes occurs throughout the entire length of said reaction chamber.

9. A circulating fluid bed steam generator according to claim 7 wherein said waterwall tubes are provided with an outward slope at or near the interface of said waterwall tubes and areas of non-uniform geometry, protrusions, or projections, such as, refractory, external feed pipes, observation ports, weld projections, or lugs.

10. A fluidized bed boiler or reactor comprising a housing, a reaction chamber within said housing, air distribution means within said reaction chamber, a plurality of perimeter walls approximately vertically disposed and arranged about the interior walls of said housing so as to define said reaction chamber, wherein the improvement comprises:

providing at least a portion of the vertically disposed waterwall tubes with an outward slope in the range between 2.5° to 10° such that the cross-section of the upper portion of said reaction chamber is smaller than the cross-section of the lower portion of said reaction chamber so as to reduce or eliminate erosion of said waterwall tubes caused by impact from downward flowing solid particles.

11. A fluidized bet boiler or reactor according to claim 10 wherein the outward slope of said perimeter walls occurs throughout the entire length of said reaction chamber.

12. A fluidized bed boiler or reactor according to claim 10 wherein said perimeter walls are provided with an outward slope at or near the interface of said perimeter wall and areas of non-uniform geometry, protrusions, or projections, such as, refractory, external feed pipes, observation ports, weld projections, or lugs.

13. A fluidized bed boiler or reactor according to claim 10 wherein said fluidized bed boiler is a circulating fluidized bet boiler having a dense bed and a dilute phase.

14. A fluidized bed boiler or reactor according to claim 13 wherein refractory is disposed about said perimeter walls in said dense bed and wherein said perimeter walls have an outward slope at or near the interface of said perimeter walls and said refractory.

15. A fluidized bed boiler or reactor according to claim 10 wherein said reaction chamber has either a square, rectangular, circular or oblong cross-section.

16. A fluidized bed boiler or reactor according to claim 10 wherein said perimeter walls are formed from metal plates.

17. A fluidized bed boiler or reactor according to claim 10 wherein said perimeter walls are formed from refractory bricks.

18. A fluidized bed boiler or reactor according to claim 10 wherein said perimeter walls are formed from tangent tubes.

* * * * *